US006046540A

United States Patent [19]

Nakamura

[11] Patent Number: 6,046,540

[45] Date of Patent: Apr. 4, 2000

[54] COLOR PICTURE TUBE

[75] Inventor: Koji Nakamura, Tokyo, Japan

[73] Assignee: Mitsubishi Denki Kabushiki Kaisha, Tokyo, Japan

[21] Appl. No.: 09/001,007

[22] Filed: Dec. 30, 1997

[30] Foreign Application Priority Data

Aug. 28, 1997 [JP] Japan ..... 9-232184

[51] Int. Cl.[7] ..... H01J 29/10

[52] U.S. Cl. ..... 313/461; 313/408

[58] Field of Search ..... 313/461, 469, 313/463, 402, 408; 348/744; 220/2.1

[56] References Cited

U.S. PATENT DOCUMENTS 4,533,590 8/1985 Tokita et al. .
5,276,377 1/1994 VAn Nes et al. ..... 313/461

FOREIGN PATENT DOCUMENTS 443657 8/1991 European Pat. Off. .
2-148544 6/1990 Japan .
259879 10/1995 Taiwan .

OTHER PUBLICATIONS

JP–06 036710A, Patent Abstract of Japan vol. 018, No. 252 (E–1547) (1994–05–13).

*Primary Examiner*—Nimeshkumar D. Patel
*Assistant Examiner*—Joseph Williams

[57] ABSTRACT

A color picture tube satisfies the following conditions. First, a value of df(r)/dr is zero in a first area on an inner surface of a panel which includes a point at which r=0, and is negative in a second area from an outside of the first area to the point at which $r=L_d$, where r denotes a radial distance from the Z-axis, and f(r) denotes a position of a point on the inner surface of the panel in a direction of the Z-axis, and the point at which $r=L_d$ denotes an outermost point in a diagonal direction of the image display area. Second, a value of $d^2f(r)/dr^2$ is negative in a third area from the point at which r=0 to an inside of a point at which $r=R_2$ being within the second area, is zero at the point at which $r=R_2$, and is positive in a fourth area from an outside of the point at which $r=R_2$ to the point at which $r=L_d$. Third, a thickness of the panel in the second area in the direction of the Z-axis is larger than that in the first area in the direction of the Z-axis.

20 Claims, 9 Drawing Sheets

| df (r)/dr | 11 | 12 |
|---|---|---|
| | 0 | NEGATIVE |

| $d^2f(r)/dr^2$ | 13 | r=R2 | 14 |
|---|---|---|---|
| | NEGATIVE | 0 | POSITIVE |

COLOR PICTURE TUBE

BACKGROUND OF THE INVENTION

The present invention relates to a color picture tube and, more specifically to a shape of a panel provided with a phosphor screen.

In a conventional color picture tube, a glass panel with a phosphor screen was commonly spherical for purpose of making the color picture tube lightweight and the like. However, by reason of development of a simulation technology in recent years and the like, it has become possible to produce a panel of a substantially flat shape.

In an actual color picture tube having a flat plate panel with parallel surfaces, however, it is recognized that portions of an image around edges of a screen appear to be floating in a greater degree toward a viewer than a portion of the image around a center of the screen, so that an image of a human face displayed on the screen, for example, which naturally should be generally elliptical, is prone to appear to be somewhat crescent-shaped.

It may be considered that the above-mentioned phenomenon occurs for the following reason. As shown in FIG. 9 schematically showing a vertical sectional view of the conventional panel, a viewer 30 views around a center of a panel 31 at a substantially right angle with respect to an outer surface of the panel 31. On the other hand, the viewer 30 views around an edge of the panel 31 obliquely at an angle $\alpha$ with respect to a Z-axis. Further, if a thickness of the panel 31 around its center when viewed in a direction normal to the center of an outer surface 31*b* of the panel 31 is represented by $T_0$, it can be seen that a thickness $T_1$ of the panel 31 around its edge when viewed in an oblique direction at the angle $\alpha$ with respect to the Z-axis, is larger than $T_0$. Accordingly, as a point being viewed by the viewer 30 approaches the edge of the screen, apparent floating distortion of the image displayed in an image display area on an inner surface 31*a* of the panel 31 (or on a phosphor screen 32) becomes greater.

As a more specific example, let us assume that a refractive index n of glass constituting the panel 31 is 1.536, size of the image display area on the panel 31 in a diagonal direction is 260 [mm], and the viewer 30 views the phosphor screen from a position 95 [mm] away from the outer surface 31*b* of the panel 31. Then, the phosphor screen recognized by the viewer 30, which is hereinafter referred to as an apparent screen 33 because it is seen as if it were located closer to the viewer 30 than the actual phosphor screen 32, is positioned at a depth of $T_0/n$ ($\approx 2T_0/3$) from the outer surface 31*b* at the center of the panel 31, that is to say, at a position of approximately $T_0/3$ floating from the inner surface 31*a* at the center of the panel 31. As a point being viewed by the viewer 30 approaches an edge of the screen, the apparent floating distortion of the apparent screen 33, which is expressed by ($T_0/3+\Delta TD$), becomes larger.

FIG. 10 shows graphs indicating results of calculations of a relationship between the viewing angle $\alpha$ degrees with respect to the Z-axis corresponding to a position of a point in the image display area of the panel 31 and an increment $\Delta TD$ of the apparent floating distortion of the image. Referring to FIG. 10, a radius of curvature of an outer surface of the panel is designated by RP [mm] and is calculated on the assumption that an inner surface of the panel is flat. However, similar results can also be obtained if the outer surface of the panel is flat and the inner surface of the panel is curved. It is also assumed in FIG. 10 that the viewer's eyes are positioned 95 [mm] away from the outer surface of the panel. The case in which RP=90000 [mm] corresponds to the case in which the panel is a flat plate with parallel surfaces. In this case, it can be seen from FIG. 10 that a portion of an image located at the viewing angle $\alpha$ of 50 degrees, for example, appears to be floating $\Delta TD$, which is approximately 2.4 [mm], toward the viewer, compared to a portion of the image around the center of the phosphor screen.

SUMMARY OF THE INVENTION

The present invention has been made to solve the above-mentioned problem associated with the conventional cathode ray tube. It is therefore an object of the present invention to provide a color picture tube in which an apparent screen recognized by a viewer is rendered flat so as to be able to display a high quality image.

According to one aspect of the present invention, a color picture tube has a panel, an inner surface of which has an image display area, and a phosphor screen provided throughout the image display area on the inner surface of the panel, for displaying an image by being subject to irradiation of an electron beam. When a Z-axis is superposed on a tube axis passing through a center of the panel and being normal to the panel, a direction from an inside of the color picture tube to a viewer is set to be a positive direction of the Z-axis, a radial distance from the Z-axis is denoted by r, a point at which the Z-axis intersects the inner surface of the panel is denoted by a point at which r=0, an outermost point in a diagonal direction of the image display area is denoted by a point at which $r=L_d$, and a position of a point on the inner surface of the panel in a direction of the Z-axis is expressed by f(r) being a function of r, the following conditions are satisfied. First, a value of df(r)/dr which is a first derivative of f(r) is zero in a first area within the image display area, which includes a point at which r=0, and is negative in a second area within the image display area from an outside of the first area to the point at which $r=L_d$. Second, a value of $d^2f(r)/dr^2$ which is a second derivative of f(r) is negative in a third area within the image display area from the point at which r=0 to an inside of a point at which $r=R_2$ being within the second area, is zero at the point at which $r=R_2$, and is positive in a fourth area within the image display surface from an outside of the point at which $r=R_2$ to the point at which $r=L_d$. Third, a thickness of the panel in the second area in the direction of the Z-axis is larger than a thickness of the panel in the first area in the direction of the Z-axis. An apparent screen can be rendered flat, so that an image of higher quality can be displayed.

Further, it is preferable that $0.4L_d \leqq R_2 \leqq 0.85L_d$ is satisfied.

According to another aspect of the present invention, a color picture tube has a panel, an inner surface of which has an image display area, and a phosphor screen provided throughout the image display area on the inner surface of the panel, for displaying an image by being subject to irradiation of an electron beam. When a Z-axis is superposed on a tube axis passing through a center of the panel and being normal to the panel, a direction from an inside of the color picture tube to a viewer is set to be a positive direction of the Z-axis, a radial distance from the Z-axis is denoted by r, a point at which the Z-axis intersects the inner surface of the panel is denoted by a point at which r=0, an outermost point in a diagonal direction of the image display area is denoted by a point at which $r=L_d$, and a position of a point on the inner surface of the panel in a direction of the Z-axis is expressed by f(r) being a function of r, the following conditions are satisfied. First, a value of df(r)/dr which is a first derivative of f(r) is zero in a first area within the image display area including a point at which r=0, is negative in a second area within the image display area from an outside of the first area to an inside of a point at which $r=R_1$, where $R_1$ is smaller than $L_d$, is zero at the point at which $r=R_1$, and is positive in a third area within the image display area from an outside of the point at which $r=R_1$ to a point at which $r=L_d$. Second, a value of $d^2f(r)/dr^2$ which is a second derivative of f(r) is negative in a fourth area within the image display area from the point at which r=0 to an inside of a point at which $r=R_2$ being within the second area, is zero at the point at which $r=R_2$, and is positive in a fifth area within the image display area from an outside of the point at which $r=R_2$ to the point at which $r=L_d$. Third, a thickness of the panel in the second area in the direction of the Z-axis is larger than a thickness of the panel in the first area in the direction of the Z-axis.

It is preferable that the following conditions are satisfied:

$$0.2L_d \leqq R_2 \leqq 0.65L_d$$

$$0.6L_d \leqq R_1 \leqq 1.0L_d$$

$$R_1 > R_2$$

Further, an outer surface of the panel may be of a substantially flat shape with a radius of curvature of not less than 60000 [mm] or not more than −60000 [mm].

Furthermore, the outer surface of the panel may be of a convex shape with a radius of curvature below 60000 [mm].

Moreover, a radius of curvature of the outer surface of the panel is larger than a radius of curvature around a center of the inner surface of the panel. Therefore, the apparent floating distortion of the apparent screen can be adjusted by means of not only the inner surface of the panel but also the outer surface of the panel, thereby relaxing design constraints of the panel.

In addition, the inner surface of the panel may be rotationally symmetrical with respect to the Z-axis, and the outer surface of the panel may be also rotationally symmetrical with respect to the Z-axis.

Further, the inner surface of the panel may be rotationally asymmetrical with respect to the Z-axis and have different configurations between a cross section cut on a horizontal plane including the Z-axis and a cross section cut on a vertical plane including the Z-axis. Since the inner surface of the panel is rotationally asymmetrical, the panel can be adapted for use with a shadow mask of a shadow grill type, of which the vertical cross section assumes a shape of a straight line and the horizontal cross section assumes a shape of an arc. Moreover, static strength of the color picture tube is increased, while at the same time the color picture tube can be rendered lightweight.

Furthermore, the outer surface of the panel may be rotationally asymmetrical with respect to the Z-axis and have different configurations between a cross section cut on a horizontal plane including the Z-axis and a cross section cut on a vertical plane including the Z-axis. Since the outer surface of the panel is rotationally asymmetrical, static strength of the color picture tube is increased, while at the same time the color picture tube can be rendered lightweight.

The color picture tube may further has a reflection preventive film provided on the outer surface of the panel. Since the reflection preventive film is provided on the outer surface of the panel, reflection of external lights that could become a factor causing a damage to picture quality can be prevented, so that the picture quality can be improved.

BRIEF DESCRIPTION OF THE DRAWINGS

The present invention will become more fully understood from the detailed description given hereinbelow and the accompanying drawings which are given by way of illustration only, and wherein.

DETAILED DESCRIPTION OF THE INVENTION

Further scope of applicability of the present invention will become apparent from the detailed description given hereinafter. However, it should be understood that the detailed description and specific examples, while indicating preferred embodiments of the invention, are given by way of illustration only, since various changes and modifications will become apparent to those skilled in the art from the detailed description.

First Embodiment

Figure 1:
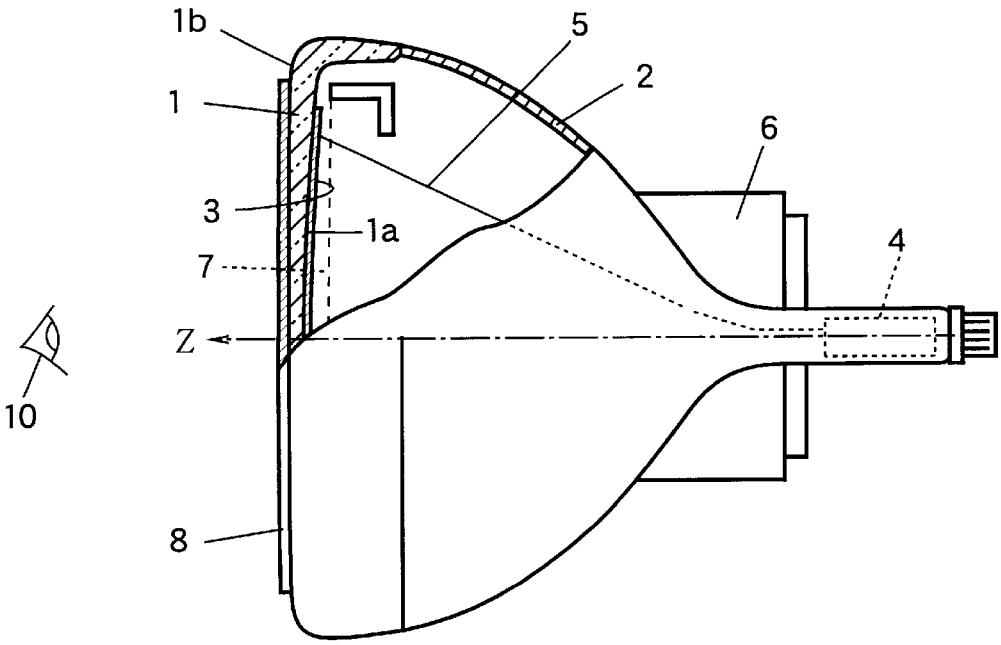
FIG. 1 is a vertical sectional view schematically showing a color picture tube partially broken away according to a first embodiment of the present invention.

FIG. 1 is a vertical sectional view schematically showing a color picture tube partially broken away according to a first embodiment of the present invention. As shown in FIG. 1, the color picture tube according to the first embodiment includes a panel 1, a funnel 2, and a phosphor screen 3 disposed on an inner surface of the panel 1, for displaying an image by being subject to irradiation of an electron beam 5. The color picture tube further includes an electron gun 4 for emitting the electron beam 5, a deflection yoke 6 for scanning the electron beam 5 in horizontal and vertical directions, a shadow mask 7 of a shadow grill type in which a plurality of vertically elongate perforations are disposed in the horizontal direction, and a reflection preventive film 8 provided on an outer surface 1*b* of the panel 1, for hindering external reflected lights. Further, in FIG. 1, a viewer is designated by a reference numeral 10.

Figure 2:
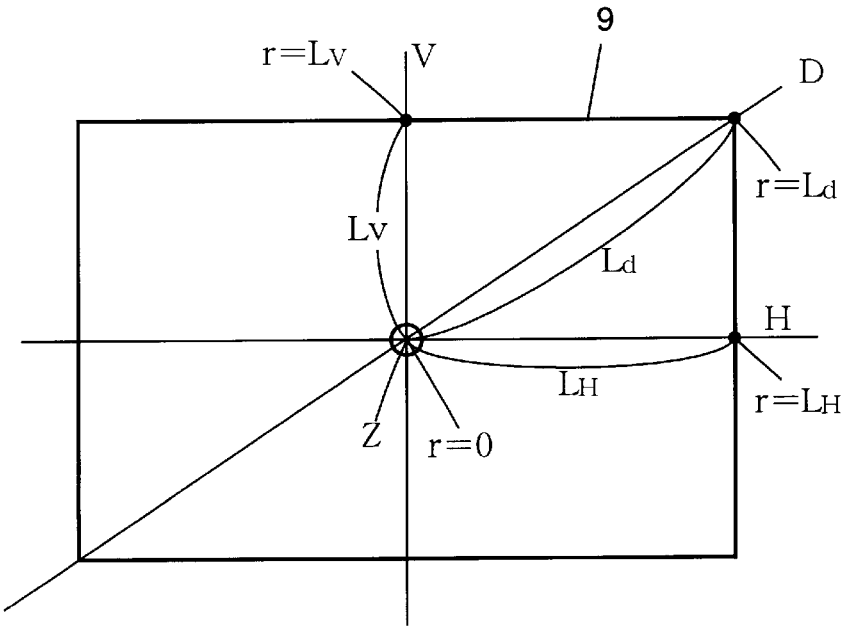
FIG. 2 is a front view of a panel of the color picture tube in FIG. 1.

FIG. 2 is a front view of the panel 1 shown in FIG. 1. Referring to FIG. 2, a reference numeral 9 denotes an image display area on the inner surface 1*a* of the panel 1 (or on the phosphor screen 3). As seen from FIG. 1 and FIG. 2, a Z-axis is superposed on a tube axis passing through a center of the panel 1 and being normal to the outer surface 1*b* of the panel 1 at the center, and a direction from an inside of the color picture tube to a viewer 10 is set to be a positive direction of the Z-axis. When a radial distance from the Z-axis to a point in the image display area 9 normal to the Z-axis is designated by r, a point at which the Z-axis intersects the inner surface 1*a* of the panel 1 is denoted by a point at which r=0. Further, an outermost point in a diagonal direction (i.e., a direction along a line D) of the image display area 9 is a point at which $r=L_d$, an outermost point in a vertical direction (i.e., a direction along a line V) of the image display area 9 is a point at which $r=L_v$, and an outermost point in a horizontal direction (i.e., a direction along a line H) of the image display area 9 is a point at which $r=L_H$.

Figure 3:
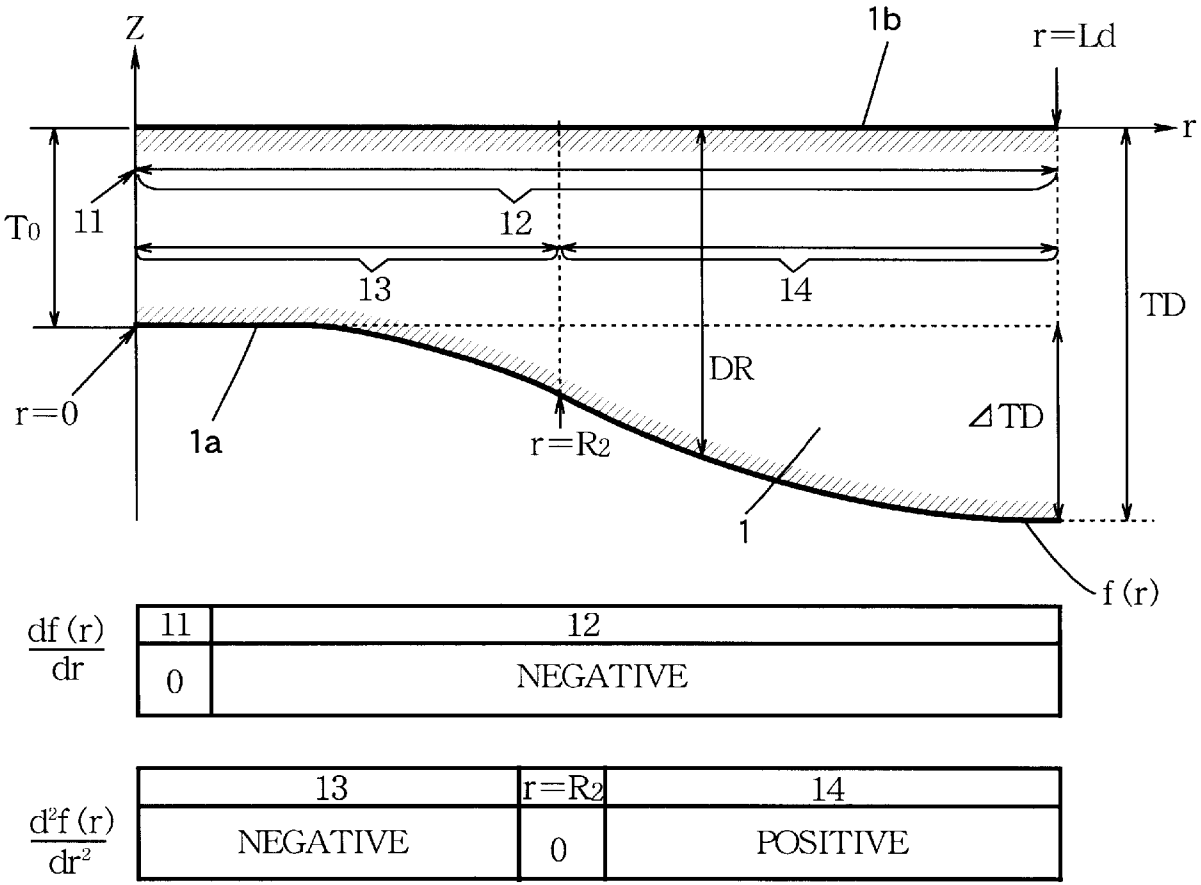
FIG. 3 is an explanatory diagram showing a cross section taken along a diagonal line of the panel of the color picture tube and indicating conditions which are satisfied by an inner surface of the panel according to the first embodiment.

FIG. 3 is an explanatory diagram showing a cross section taken along the diagonal line of the panel of the color picture tube and indicating conditions which are satisfied by the inner surface of the panel according to the first embodiment. The panel 1 in the color picture tube according to the first embodiment is formed so as to be rotationally symmetrical with respect to the Z-axis and also to meet requirements to be described below.

When a position Z of a point on the inner surface 1*a* of the panel 1 in the direction of the Z-axis is expressed by an equation Z=f(r) as a function of a variable r, a value of a first derivative df(r)/dr of f(r) in the image display area 9 (not shown in FIG. 3) on the inner surface 1*a* of the panel 1 is zero in a first area 11 within the image display area 9 including the point at which r=0. Further, a value of df(r)/dr is negative in a second area 12 within the image display area 9 from an outside of the first area 11 to the point at which $r=L_d$. Incidentally, in this embodiment, the first area 11 consists solely of the point at which r=0. The first area 11, however, may be larger than that in this embodiment.

Moreover, a value of a second derivative $d^2f(r)/dr^2$ of f(r) in the image display area 9 on the inner surface 1*a* of the panel 1 is negative in a third area 13 within the image display area 9 from the point at which r=0 to an inside of a point at which $r=R_2$, where the point at which $r=R_2$ is within the second area 12 (that is to say, from the point at which r=0 to a point at which $r=R_2$, but not including the point at which $r=R_2$, where the point at which $r=R_2$ is within the second area 12). A value of $d^2f(r)/dr^2$ is zero at the point at which $r=R_2$, and be positive in a fourth area 14 within the image display area 9 from an outside of the point at which $r=R_2$ to the point at which $r=L_d$ (that is to say, from the point at which $r=R_2$, but not including the point at which $r=R_2$, to the point at which $r=L_d$).

Further, when a thickness of the panel 1 in the second area 12 in the direction of the Z-axis is represented by DR and a thickness of the panel 1 in the first area 11 in the direction of direction of the Z-axis is represented by $T_0$, $DR/T_0>1$ is satisfied.

Still further, the outer surface 1*b* of the panel 1 is substantially flat, which means that a radius of curvature of the outer surface is not less than 60000 [mm] indicating a slightly convex surface and not more than −60000 [mm] indicating a slightly concave surface.

The position of the point at which $r=R_2$ which satisfies the equation $d^2f(r)/dr^2=0$ is preferably set to fulfill a relation $0.4L_d \leqq R_2 \leqq 0.85L_d$.

When a position of the center of the inner surface 1*a* of the panel 1 is expressed by the point at which f(r)=0, a shape of the inner surface 1*a* of the panel 1 can be expressed, for example, by the following equations:

$$Z=f(r)=r^2(ar^2+b)$$

$$a=1.4787e^{-9}$$

$$b=-6.4161e^{-5}$$

The above equations indicate that the shape of the inner surface 1*a* of the panel 1 is rotationally symmetrical with respect to the Z-axis. Now, let us assume that a thickness of the panel 1 at its center in the direction of the Z-axis is represented by $T_0$, and a thickness of an edge (at which $r=L_d$) of the panel 1 in the diagonal direction is expressed by an equation $TD=T_0+\Delta TD$. Then, if $T_0$ is 13.0 [mm], for example, ΔTD becomes 0.675 [mm]. ΔTD indicates an increment of the thickness $T_0$ from the center of the panel 1 to the point at which $r=L_d$, and referred to as a wedge.

Figure 4:
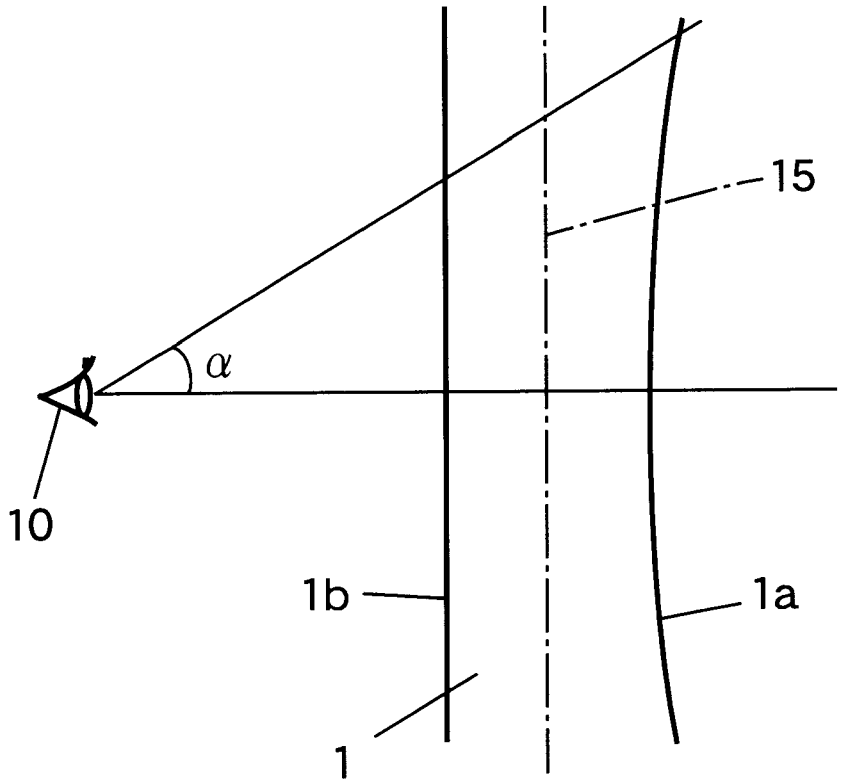
FIG. 4 is an explanatory diagram showing an apparent screen recognized by an viewer according to the first embodiment.

In this embodiment, the inner surface 1*a* of the panel 1 is made aspherical, being formed such that the radius of curvature around the center of the inner surface 1*a* is approximately 8500 [mm] and the radius of curvature around the edge of the inner surface 1*a* is larger than 8500 [mm]. With this arrangement, the apparent floating distortion of the portion of the image around the edge of the inner surface 1*a* of the panel 1 is greatly reduced, and at the same time, the floating of the portion of the image resulting from the radius of curvature of approximately 8500 [mm] around the center of the inner surface 1*a* of the panel 1 can be recognized. By arranging the inner surface of the panel 1 to be aspherical in this way, an apparent screen 15 can be rendered more flat, as shown by a chained line in FIG. 4.

As described above, in the color picture tube according to the first embodiment, the inner surface 1*a* of the panel 1 is shaped so as to satisfy the requirements described above. Thus, the apparent screen can be rendered more flat, so that an image of higher quality can be displayed.

Second Embodiment

Figure 5:
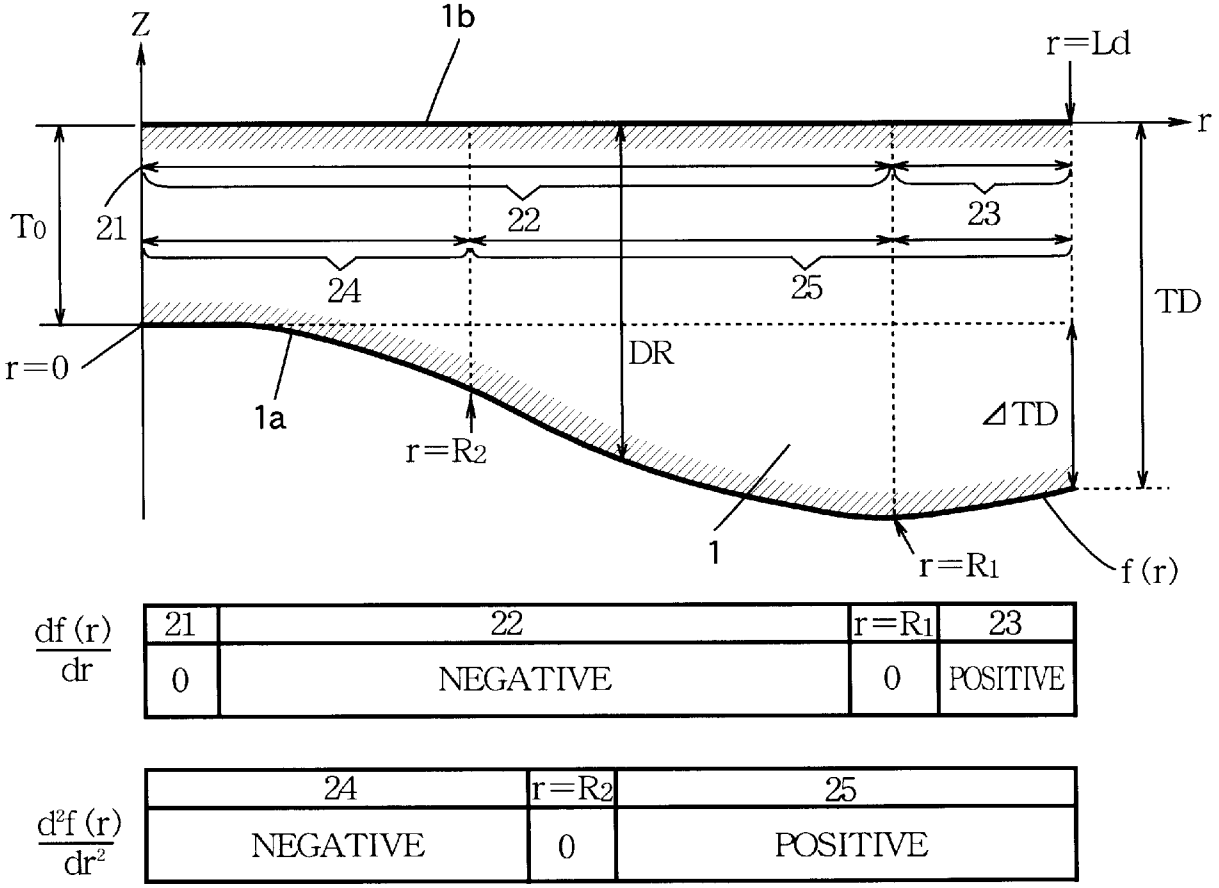
FIG. 5 is an explanatory diagram showing a cross section taken along a diagonal line of a panel of a color picture tube and indicating conditions which are satisfied by an inner surface of the panel according to a second embodiment of the present invention.

FIG. 5 is an explanatory diagram showing a cross section taken along a diagonal line of a panel of a color picture tube and indicating conditions which are satisfied by an inner surface of the panel according to a second embodiment of the present invention. As shown in FIG. 5, a shape of the panel 1 of the color picture tube according to the second embodiment is formed so as to be rotationally symmetrical with respect to the Z-axis and also to satisfy requirements to be described below.

Referring to FIG. 1, FIG. 2 and FIG. 5, when a position Z of a point on the inner surface 1*a* of the panel 1 in the direction of the Z-axis is expressed by an equation Z=f(r) as a function of a variable r in the same manner as that in the first embodiment, a value of a first derivative df(r)/dr of f(r) on the image display area 9 (not shown in FIG. 5) on the inner surface 1*a* of the panel 1 is zero in a first area 21 within the image display area 9 including the point at which r=0. Further, the value of df(r)/dr is negative in a second area 22 within the image display area 9 from an outside of the first area 21 to an inside of a point at which $r=R_1$, $R_1$ being smaller than $L_d$ (that is to say, from an outside of the first area 21 to a point at which $r=R_1$, but not including the point at which $r=R_1$ and $R_1$ being smaller than $L_d$). Still further, the value of df(r)/dr is zero at the point at which $r=R_1$, and is positive in a third area 23 within the image display area 9 from an outside of the point at which $r=R_1$ to the point at which $r=L_d$ (that is to say, from the point at which $r=R_1$, but not including the point at which $r=R_1$, to the point at which $r=L_d$). Incidentally, in this embodiment, the first area 21 consists solely of the point at which r=0. The first area 21, however, may be larger than that in this embodiment.

Moreover, a value of the second derivative $d^2f(r)/dr^2$ of f(r) in the image display area 9 on the inner surface 1*a* of the panel 1 is negative in a fourth area 24 within the image display area 9 from the point at which r=0 to an inside of a point at which $r=R_2$ being within the second area 22 (that is to say, from the point at which r=0 to a point at which $r=R_2$, but not including the point at which $r=R_2$). The value of $d^2f(r)/dr^2$ is zero at the point at which $r=R_2$, and is positive in a fifth area 25 within the image display area 9 from an outside of the point at which $r=R_2$ to the point at which $r=L_d$ (that is to say, from the point at which $r=R_2$, but not including the point at which $r=R_2$, to the point at which $r=L_d$).

Further, when a thickness of the panel 1 in the second area 22 in the direction of the Z-axis is represented by DR and a thickness of the panel 1 in the first area 21 in the direction of the Z-axis is represented by $T_0$, a condition $DR/T_0>1$ is satisfied.

Still further, the outer surface 1*b* of the panel 1 is substantially flat, which means that a radius of curvature of the outer surface is not less than 60000 [mm] indicating a slightly convex surface and not more than −60000 [mm] indicating a slightly concave surface.

The position of the point at which $r=R_2$ which satisfies the equation $d^2f(r)/dr^2=0$ is preferably set to fulfill a relation $0.2L_d \leqq R_2 \leqq 0.65L_d$, and the position of the point at which $r=R_1$ which satisfies the equation df(r)/dr=0 is preferably set to fulfill a condition $0.6L_d \leqq R_1 \leqq 1.0L_d$. In addition, $R_1$ is larger than $R_2$.

When a position of a center of the inner surface 1*a* of the panel 1 is expressed by an equation f(r)=0, a shape of the inner surface 1*a* of the panel 1 can be expressed, for example, by the following equations:

$$Z=f(r)=r^2(ar^2+b)$$

$$a=4.626e^{-9}$$

$$b=-9.4096e^{-5}$$

The above equations indicate that the shape of the inner surface 1*a* of the panel 1 is rotationally symmetrical with respect to the Z-axis. Now, let us assume that a thickness of the panel 1 at its center in the direction of the Z-axis is represented by $T_0$, and a thickness of an edge (at which $r=L_d$) of the panel 1 in the diagonal direction, is expressed by an equation $TD=T_0+\Delta TD$. Then, if $T_0$ is 13.0 [mm], for example, ΔTD becomes 0.20 [mm]. ΔTD indicates an increment of the thickness $T_0$ from the center of the panel 1 to the point at which $r=L_d$, and referred to as a wedge.

Moreover, in the second embodiment, the inner surface 1*a* of the panel 1 is made aspherical, being formed such that a radius of curvature around a center of the inner surface 1*a* is approximately 8500 [mm] and a radius of curvature around edges of the inner surface 1*a* are larger than 8500 [mm]. With this arrangement, an apparent floating distortion of portions of an image around the edges of the inner surface 1*a* of the panel 1 is greatly reduced, and at the same time, the floating of the portion of the image resulting from the radius of curvature of 8500 [mm] around the center of the inner surface 1*a* of the panel 1 can be recognized. By arranging the inner surface of the panel 1 to be aspherical in this way, an apparent screen recognized by the viewer can be rendered more flat.

As described above, in the color picture tube according to the second embodiment, the inner surface 1*a* of the panel 1 is shaped so as to satisfy the requirements described above. Thus, the apparent screen can be rendered more flat, so that an image of higher quality can be displayed.

In all respects other than those set forth above, the second embodiment is identical with the first embodiment.

Third Embodiment

Figure 6:
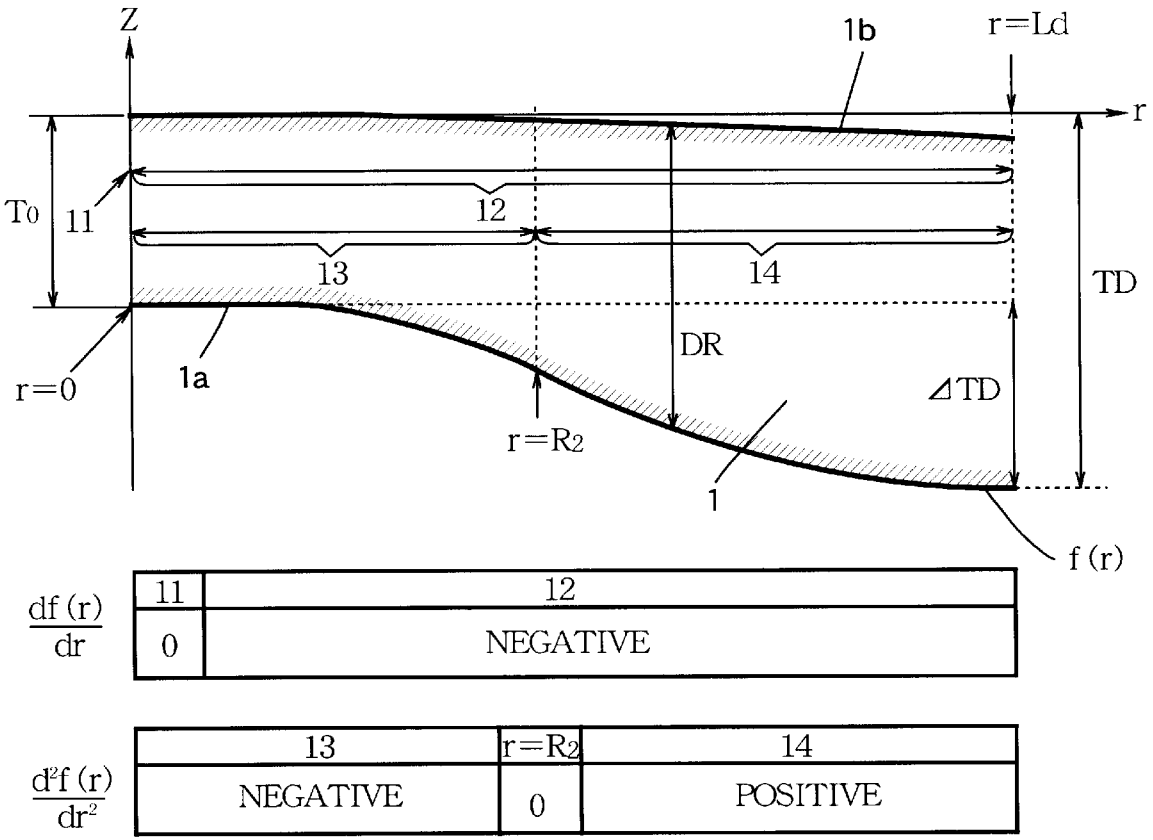
FIG. 6 is an explanatory diagram showing a cross section taken along a diagonal line of a panel of a color picture tube and indicating the conditions which are satisfied by an inner surface of the panel according to a third embodiment of the present invention.

FIG. 6 is an explanatory diagram showing a cross section taken along a diagonal line of a panel of a color picture tube and indicating conditions which are satisfied by an inner surface of the panel according to a third embodiment of the present invention. In FIG. 6, structural elements that are identical or corresponding to those in FIG. 3 in the first embodiment are designated by the same reference numerals or characters.

The color picture tube according to the third embodiment is different from that described above according to the first embodiment only in that the outer surface 1*b* of the panel 1 is slightly convex and has the radius of curvature of 20000 [mm]. In the color picture tube according to the third embodiment, the apparent screen can be rendered flat, so that an image of higher quality can be displayed. In addition, the apparent floating distortion of the image can be corrected by means of not only the inner surface 1*a* of the panel 1 but also the outer surface 1*b* of the panel 1.

Figure 7:
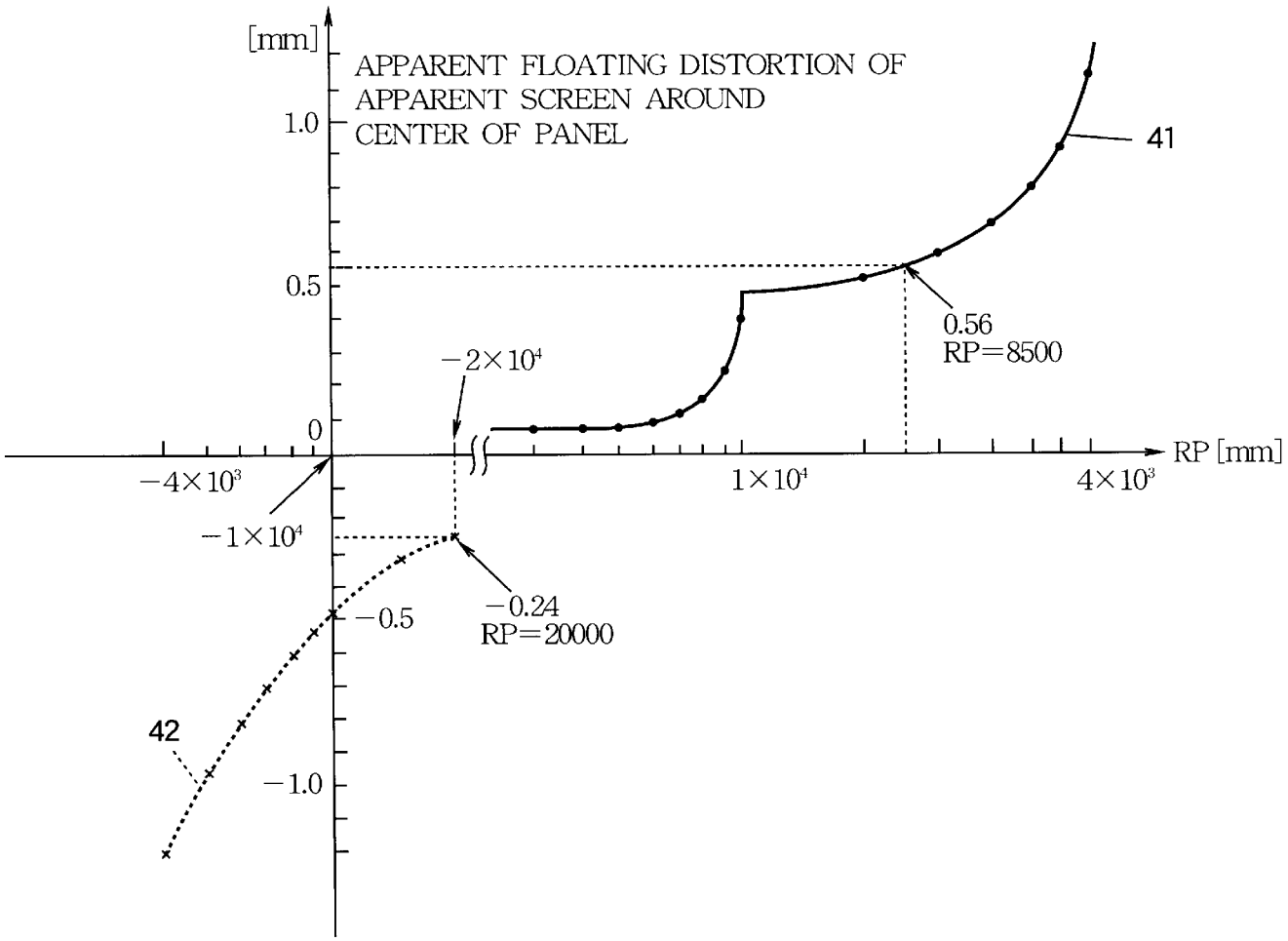
FIG. 7 shows characteristic curves indicating a relationship between a radius of curvature around a center of the inner surface of the panel and an apparent floating distortion of an apparent phosphor screen, and a relationship between a radius of curvature around a center of the outer surface of the panel and an apparent floating distortion of the apparent phosphor screen.

FIG. 7 shows characteristic curves indicating a relationship indicated by a solid line 41 between a radius of curvature around a center of the inner surface of the panel and an apparent floating distortion of an apparent phosphor screen, and a relationship indicated by a broken line 42 between a radius of curvature around a center of the outer surface of the panel and an apparent floating distortion of an apparent phosphor screen. As seen from FIG. 7, if the inner surface 1*a* is rotationally symmetrical with the radius of curvature RP being 8500 [mm], for example, the apparent floating distortion is +0.56 [mm] in the direction of the Z-axis. If the outer surface 1*b* is rotationally symmetrical with the radius of curvature RP being 20000 [mm] for example, the apparent floating distortion is −0.24 [mm] in the direction of the Z-axis. Accordingly, at the center of the panel 1 alone, the apparent floating distortion will be a sum of +0.56 [mm] and −0.24 [mm], namely, +0.32 [mm]. The characteristic curves in FIG. 7 can be used for designing the apparent screen to be flat.

The third embodiment is identical with the first embodiment described above in all respects other than those set forth above.

Fourth Embodiment

Figure 8:
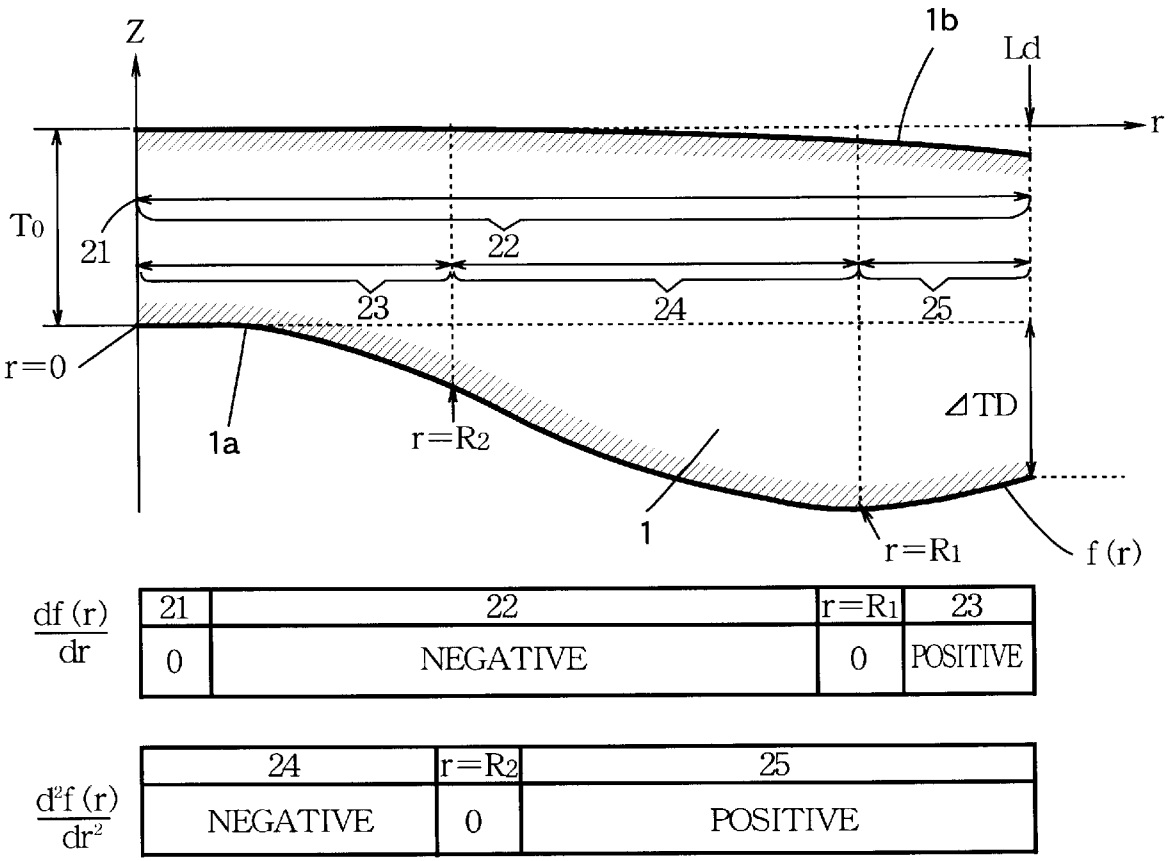
FIG. 8 is an explanatory diagram showing a cross section taken along a diagonal line of a panel of a color picture tube and indicating conditions which are satisfied by an inner surface of a panel according to a fourth embodiment of the present invention.
Figure 9:
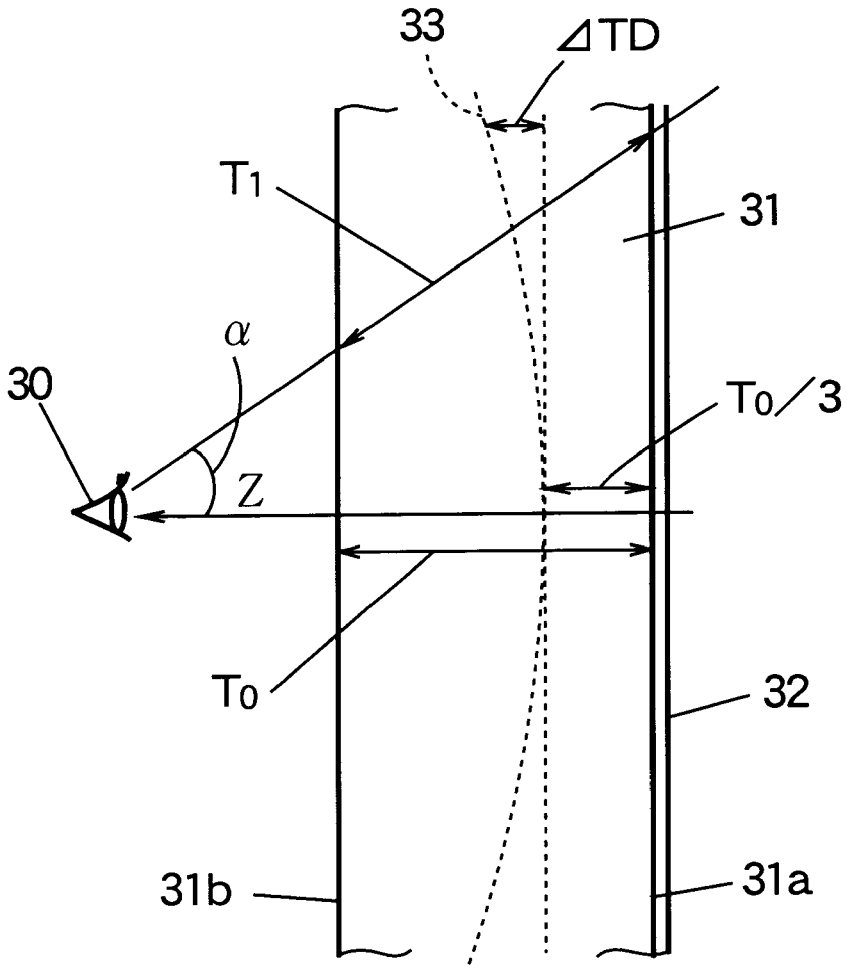
FIG.9 CONVENTIONAL ART
FIG. 9 is a vertical sectional view schematically showing the conventional panel.
Figure 10:
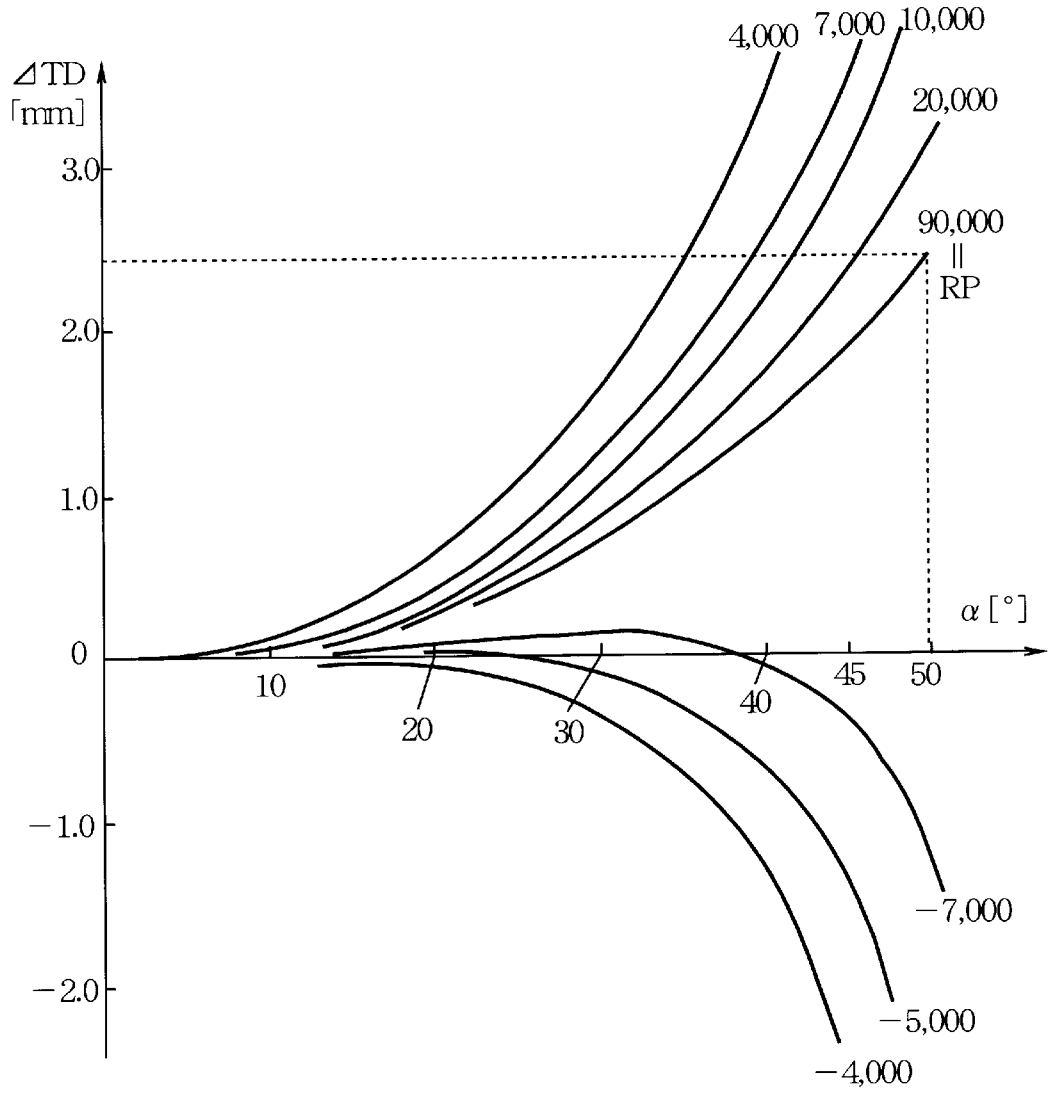
FIG.10 CONVENTIONAL ART
FIG. 10 shows graphs indicating the results of calculation of the relationship between the viewing angle $\alpha$ degrees with respect to the Z-axis and the increment $\Delta TD$ of the apparent floating distortion of the image.

FIG. 8 is an explanatory diagram showing a cross section taken along a diagonal line of a panel of a color picture tube and indicating conditions which are satisfied by an inner surface of the panel according to a fourth embodiment of the present invention. In FIG. 8, structural elements that are identical or corresponding to those in FIG. 5 in the second embodiment are designated by like numerals or characters.

The color picture tube according to the fourth embodiment is different from that in the second embodiment described above only in that the outer surface of the panel 1 is slightly convex and has the radius of curvature of 20000 [mm]. In the color picture tube according to the fourth embodiment, an apparent screen can be rendered flat, so that an image of higher quality can be displayed. In addition, an apparent floating distortion of the image can be corrected by means of not only the inner surface 1*a* of the panel 1 but also the outer surface 1*b* of the panel 1.

In all respects other than those set forth above, the fourth embodiment is identical with the second embodiment.

Fifth Embodiment

In the first through fourth embodiments, a description has been directed to the cases where the inner surface of the panel 1 is rotationally symmetrical with respect to the Z-axis. The present invention, however, is not limited to this. The inner surface of the panel 1 may be rotationally asymmetrical and have different configurations between a cross section cut on a horizontal plane including the Z-axis and the horizontal axis H (shown in FIG. 2) and a cross section cut on a vertical plane including the Z-axis and the vertical axis V (shown in FIG. 2), as long as the a shape of the panel 1 is formed so as to satisfy requirements described above.

For instance, a curvature of a cross section of the inner surface 1*a* taken along the vertical axis V is smaller than that taken along the horizontal axis H (that is, the inner surface 1*a* of the panel 1 is formed to be more flat), and the inner surface of the panel 1 is formed so as to be both continuous and smooth. In this case, a radius of curvature R of the inner surface 1*a* of the panel 1 in an area between the vertical axis V and the horizontal axis H, at an angle θ with respect to the vertical axis V can be calculated by the following equation:

$$1/R^2=(\cos^2\theta)/RV^2+(\sin^2\theta)/RH^2$$

where RV represents a radius of curvature of the cross section of the inner surface 1*a* of the panel 1 taken along the vertical axis V, and RH represents a radius of curvature of the cross section of the inner surface of the panel 1 taken along the horizontal axis H.

This rotationally asymmetrical panel 1 is suitable for use with a shadow mask of a shadow grill type, the surfaces of which are straight when the shadow mask is vertically cut and are curved when it is horizontally cut. The inner surface of the panel 1 is designed on the basis of a distance between the inner surface 1*a* of the panel 1 and a shadow mask 7 (shown in FIG. 2), a distance from a center of deflection of an electronic beam to the phosphor screen 3, a pitch of perforations in the shadow mask 7 and the like.

By forming the inner surface of the panel 1 to be rotationally asymmetrical, static strength of the color picture tube is increased, while at the same time the color picture tube can be rendered lightweight.

In this embodiment, a description has been directed to the case where the inner surface 1*a* of the panel 1 is formed to be rotational asymmetrical. The present invention is not limited to this. The outer surface 1*b* of the panel 1 may be formed to be rotationally asymmetrical, alternatively.

In all respects other than those set forth above, the fifth embodiment is identical with any one of the first through fourth embodiments.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A color picture tube comprising:

a panel, an inner surface of which has an image display area; and a phosphor screen provided throughout the image display area on the inner surface of said panel, for displaying an image by being subject to irradiation of an electron beam; wherein:

a Z-axis is superposed on a tube axis passing through a center of said panel and being normal to said panel;

a direction from an inside of the color picture tube to a viewer is set to be a positive direction of the Z-axis;

a radial distance from the Z-axis is denoted by r;

a point at which the Z-axis intersects the inner surface of said panel is denoted by a point at which r=0;

an outermost point in a diagonal direction of the image display area is denoted by a point at which $r=L_d$;

a position of a point on the inner surface of said panel in a direction of the Z-axis is expressed by f(r) being a function of r;

a value of df(r)/dr which is a first derivative of f(r) is zero in a first area within the image display area, which includes a point at which r=0, and is negative in a second area within the image display area from an outside of the first area to the point at which $r=L_d$;

a value of $d^2f(r)/dr^2$ which is a second derivative of f(r) is negative in a third area within the image display area from the point at which r=0 to an inside of a point at which $r=R_2$ being within the second area, is zero at the point at which $r=R_2$, and is positive in a fourth area within the image display surface from an outside of the point at which $r=R_2$ to the point at which $r=L_d$; and a thickness (DR) of said panel in the second area in the direction of the Z-axis is larger than a thickness ($T_0$) of said panel in the first area in the direction of the Z-axis.

2. The color picture tube according to claim 1, wherein the following condition is satisfied:

$$0.4L_d \leq R_2 \leq 0.85L_d.$$

3. The color picture tube according to claim 1, wherein an outer surf ace of said panel is of a substantially flat shape with a radius of curvature of not less than 60000 [mm] or not more than −60000 [mm].

4. The color picture tube according to claim 1, wherein an outer surface of said panel is of a convex shape with a radius of curvature below 60000 [mm].

5. The color picture tube according to claim 4, wherein the radius of curvature of the outer surface of said panel is larger than a radius of curvature around a center of the inner surface of said panel.

6. The color picture tube according to claim 1, wherein the inner surface of said panel is rotationally symmetrical with respect to the Z-axis.

7. The color picture tube according to of claim 1, wherein the outer surface of said panel is rotationally symmetrical with respect to the Z-axis.

8. The color picture tube according to claim 1, wherein the inner surface of said panel is rotationally asymmetrical with respect to the Z-axis and has different configurations between a cross section cut on a horizontal plane including the Z-axis and a cross section cut on a vertical plane including the Z-axis.

9. The color picture tube according to claim 1, wherein the outer surface of said panel is rotationally asymmetrical with respect to the Z-axis and has different configurations between a cross section cut on a horizontal plane including the Z-axis and a cross section cut on a vertical plane including the Z-axis.

10. The color picture tube according to claim 1, further comprising a reflection preventive film provided on the outer surface of said panel.

11. A color picture tube comprising:

a panel, an inner surface of which has an image display area; and a phosphor screen provided throughout the image display area on the inner surface of said panel, for displaying an image by being subject to irradiation of an electron beam; wherein:

a Z-axis is superposed on a tube axis passing through a center of said panel and being normal to said panel;

a direction from an inside of the color picture tube to a viewer is set to be a positive direction of the Z-axis;

a radial distance from the Z-axis is denoted by r;

a point at which the Z-axis intersects the inner surface of said panel is denoted by a point at which r=0;

an outermost point in a diagonal direction of the image display area is denoted by a point at which $r=L_d$;

a position of a point on the inner surface of said panel in a direction of the Z-axis is expressed by f(r) being a function of r;

a value of df(r)/dr which is a first derivative of f(r) is zero in a first area within the image display area including a point at which r=0, is negative in a second area within the image display area from an outside of the first area to an inside of a point at which $r=R_1$, where $R_1$ is smaller than $L_d$, is zero at the point at which $r=R_1$, and is positive in a third area within the image display area from an outside of the point at which $r=R_1$ to a point at which $r=L_d$;

a value of $d^2f(r)/dr^2$ which is a second derivative of f(r) is negative in a fourth area within the image display area from the point at which r=0 to an inside of a point at which $r=R_2$ being within the second area, is zero at the point at which $r=R_2$, and is positive in a fifth area within the image display area from an outside of the point at which $r=R_2$ to the point at which $r=L_d$; and a thickness of said panel in the second area in the direction of the Z-axis is larger than a thickness of said panel in the first area in the direction of the Z-axis.

12. The color picture tube according to claim 11, wherein the following conditions are satisfied:

$$0.2L_d \leqq R_2 \leqq 0.65L_d$$

$$0.6L_d \leqq R_1 \leqq 1.0L_d$$

$$R_1 > R_2.$$

13. The color picture tube according to claim 11, wherein an outer surface of said panel is of a substantially flat shape with a radius of curvature of not less than 60000 [mm] or not more than −60000 [mm].

14. The color picture tube according to claim 11, wherein an outer surface of said panel is of a convex shape with a radius of curvature below 60000 [mm].

15. The color picture tube according to claim 14, wherein the radius of curvature of the outer surface of said panel is larger than a radius of curvature around a center of the inner surface of said panel.

16. The color picture tube according to claim 11, wherein the inner surf ace of said panel is rotationally symmetrical with respect to the Z-axis.

17. The color picture tube according to claim 11, wherein the outer surface of said panel is rotationally symmetrical with respect to the Z-axis.

18. The color picture tube according to claim 11, wherein the inner surface of said panel is rotationally asymmetrical with respect to the Z-axis and has different configurations between a cross section cut on a horizontal plane including the Z-axis and a cross section cut on a vertical plane including the Z-axis.

19. The color picture tube according to claim 11, wherein the outer surface of said panel is rotationally asymmetrical with respect to the Z-axis and has different configurations between a cross section cut on a horizontal plane including the Z-axis and a cross section cut on a vertical plane including the Z-axis.

20. The color picture tube according to claim 11, further comprising a reflection preventive film provided on the outer surface of said panel.

* * * * *